United States Patent [19]

Luke

[11] 3,949,675

[45] Apr. 13, 1976

[54] PROJECTILE

[75] Inventor: Frank A. Luke, Feasterville, Pa.

[73] Assignee: The United States of America as represented by the Secretary of the Army, Washington, D.C.

[22] Filed: July 3, 1974

[21] Appl. No.: 485,477

[52] U.S. Cl. ..... 102/80; 102/74

[51] Int. Cl.[2] ..... F42C 1/04; F42C 9/16

[58] Field of Search ..... 102/79, 80, 74

[56] References Cited

UNITED STATES PATENTS

| | | | |
|---|---|---|---|
| 2,656,793 | 10/1953 | Howell | 102/80 |
| 2,715,873 | 8/1955 | Thompson | 102/80 X |
| 3,326,132 | 6/1967 | Tlam | 102/80 |

*Primary Examiner*—Verlin R. Pendegrass
*Attorney, Agent, or Firm*—Nathan Edelberg; Robert P. Gibson

[57] ABSTRACT

A point detonating, high explosive incendiary projectile having a safe self destruct fuze that is operative only after setback and spin forces have been imparted to the launched projectile. The fuze includes a rotor housing that is slidable in and spring biased toward the forward portion of a conically shaped nose member. A ball rotor in the rotor housing has a peripheral recess for receiving a tip of the firing pin carried by the nose cap when ball detents in the housing sidewall lock the ball rotor in an unarmed condition prior to projectile launch. A detonator in the periphery of the ball rotor is offset from the recess and is moved to an armed position after rotor freeing of detent unlocking setback and a predetermined amount of spin or centrifugal force. Should the projectile fail to strike a target, upon diminishing spin or centrifugal force, the ball detents re-engage the ball rotor to lock it in armed condition and the rotor housing is biased forwardly toward the firing pin tip for initiating the detonator.

4 Claims, 1 Drawing Figure

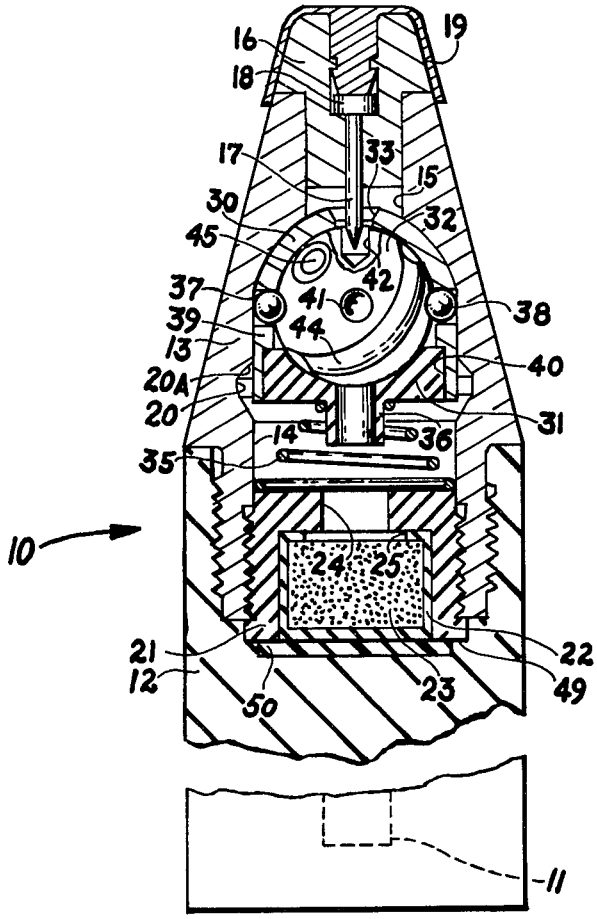
16
19
18
17
33
15
30
32
45
42
37
41
38
39
44
13
40
20A
20
31
14
36
35
10
24
25
21
22
12
23
49
50
11

PROJECTILE

The invention described herein may be manufactured, used, and licensed by or for the Government for governmental purposes without the payment to me of any royalty thereon.

This invention relates to projectiles, and more particularly to a point-detonating high explosive projectile.

It is an object of the invention to provide a point-detonating high explosive incendiary projectile having self destruction capability.

Another object of the invention is to provide such a projectile which is safe from accidental initiation due to rough handling.

A further object of the invention is to provide such a projectile having a minimum number of parts and in which temperature sensitiveness is minimized.

These and other objects, features and advantages will become more apparent from the following description and accompanying drawing which is a longitudinal sectional view, partially broken away, of a projectile embodying the principles of the invention.

The point detonating high explosive incendiary projectile, shown generally at 10, contains a high explosive main charge 11 which normally is ignited upon impact of the projectile with a predetermined target. The forward internal surface of the projectile cylindrical wall 12 is threaded for securement of the conically shaped nose member 13 that has a central rearwardly opening cylindrical cavity 14, the hemispherical base of which is in fluid communication with the central longitudinally extending cylindrical passage 15. Force-fittingly secured in passage 15 is a plastic nose cap 16 having the enlarged head 18 of a rearwardly protruding firing pin 17 secured therein by a barbed stub of the steel nose shield 19. The cavity wall of nose member 13 has an annular groove 20 of predetermined contour for a purpose to be described and has a rearmost threaded portion for securement of a steel base member 21 containing an aluminum lead cup assembly 22 with its lead charge of high explosive 23 which in in fluid communication with the cavity 14. Appropriate central openings 24, 25 are provided in the forward walls of the base and cup, respectively.

Slidably mounted in the nose member cavity 14 is a rotor housing assembly comprising an upper or forward body 30 and a lower or rearward body 31 each having internal spherical surface portions to cooperatively accommodate the spherical surface of ball rotor 32. The forward portion of upper body 30 is substantially hemispherical in shape, for seating in the hemispherical base of cavity 14, and has a suitably tapered central opening 33 that receives the tip of firing pin 17 with substantial clearance when the rotor housing is biased forwardly by the conical or tapered setback or compression spring 35. The rearward larger end of spring 35 seats against the forwardmost surface of base 21 and the forward smaller end of spring 35 telescopingly surrounds the centrally apertured hub 36 of lower body 31. The rotor housing upper body 30 has a plurality (preferably four) of peripherally spaced openings 37 in its sidewall to each carry one of a series of ball detents 38 for a purpose to be described, and the rearward cylindrical end portion 39 has an annular recess 40 that receives with a sliding fit the cylindrical peripheral surface of lower body 31.

The ball rotor 32, in its initial assembled position, has a plurality of concave spherical recesses 41 in the ball rotor peripheral surface with each of the circumferentially spaced recesses 41 retaining a sufficient mating surface portion of a corresponding inwardly biased or cammed ball detent 38 to secure the ball rotor 32 against movement within the rotor housing in its forwardmost position. Recesses 41 lie in a transverse plane that extends through a major diameter or center of the ball rotor and is transverse to an initial longitudinally extending diameter which passes substantially through the center of a cylindrical recess 42 in the surface of ball rotor 32. Recess 42 aligns with upper body opening 33 and receives the tip extremity of firing pin 17 with sufficient lateral clearance as viewed in the drawing. A peripheral annular groove 44, recessed with a continuous concave surface for subsequent reception of ball detents 38, is provided in the external surface of the ball rotor 32 at a predetermined major diameter location thereon. Groove 44 extends in a plane that has a predetermined inclination relative to the first mentioned transverse plane containing recesses 41. Preferably centered on the rotor ball principle moment of inertia axis, which is normal or perpendicular to the second mentioned plane of groove 44, is a detonator 45 that is appropriately secured in a rotor ball peripheral surface cavity. The detonator 45 is offset from recess 42 and is adapted to subsequently align with the firing pin 17 when the ball detents 38 later engage with the annular groove 44, as will be described.

The rearward surfaces of the base 21 and lead cup 22 are covered with a pressure sensitive aluminum tape 49 to seal the fuze and secure a sponge rubber support pad 50 for the lead cup.

With the ball detents 38 initially engaging recesses 41 the ball rotor 32 is initially locked in the rotor housing in an unarmed position. Upon launching of the projectile, the associated set-back forces cause the rotor housing to slide rearwardly and compress spring 35 as the ball rotor 32 and rotor housing are disengaged from the firing pin 17. With the spring 35 sufficiently compressed, accompanying projectile spin causes the ball detents 38 to move radially outward for locking engagement in the annular groove 20, thereby locking the rotor housing rearward and undetenting or freeing the ball rotor to move, in response to centrifugal force impartation thereto, to an armed position with its principle moment of inertia axis and detonator 45 aligned with upper body opening 33 and firing pin 17.

At this juncture the fuze is armed and will detonate upon impact of the crushable nose cap 16 with a target, as a shock wave from the detonator 45 ignites the lead charge 23 which in turn ignites the projectile main or high explosive charge 11. Should no target impact or only a graze impact occur, upon diminishing spin or centrifugal force the projectile will destroy itself. When the ball rotor 32 has moved to an armed position, its annular groove 44 will align with the rotor housing sidewall openings 37 and the ball detents 38 therein which are biased outwardly by centrifugal force during projectile spin. When the spin of the projectile decays sufficiently to allow the force of the compressed spring 35, with the assistance of the forward conically inclined or tapered camming ramp surface portion 20A of groove 20, to overcome the radial force on ball detents 38, the entire armed rotor housing assembly will move forward and force the detonator 45 into the firing pin 17. During this movement the detonator is locked in its aligned or armed position by the detent balls 38 which engage the peripheral groove 44 of the ball rotor.

Various modifications, changes or alterations may be resorted to without departing from the scope of the invention as defined by the appended claims.

I claim:

1. In a point detonating projectile having a conically shaped nose member secured to a high explosive ammunition round and a nose cap secured to said nose and carrying a rearwardly directed firing pin, a self destruct fuze mounted in said nose and having a rotor housing slidably mounted within a forward portion of said nose, a base member containing a lead charge and secured to a rearward portion of said nose, a compression spring intermediate said base member and said rotor housing for normally biasing said rotor housing forwardly towards said firing pin, and a ball rotor in said rotor housing and having a peripheral recess for normally receiving a tip of said firing pin and a detonator in its periphery offset from said recess, said fuze having means carried by said rotor housing for normally locking said ball rotor in an unarmed position prior to receiving projectile launching set-back forces, for preventing forward motion of the retracted rotor housing during a projectile spin period in which a predetermined amount of centrifugal force is imparted thereto, and for locking said ball rotor in an armed position and enabling the armed rotor and its housing to move forward in said nose when said centrifugal force is substantially reduced, so that the fuze self destructs should the projectile fail to strike a target.

2. The structure in accordance with claim 1 wherein said ball rotor has a moment of inertia axis extending through said detonator.

3. The structure of claim 2 wherein said rotor housing has a central forwardmost opening in alignment with said ball rotor recess in the unarmed condition of said ball rotor and which will be in alignment with said detonator after spin is imparted to said projectile.

4. The structure of claim 3 wherein said ball rotor has a plurality of spherically shaped recesses peripherally spaced in a plane extending normal to said tip receiving recess, and an annular peripheral groove in said ball rotor extending in a plane normal to said detonator.

* * * * *